US007605671B2

(12) United States Patent
Liang et al.

(10) Patent No.: US 7,605,671 B2
(45) Date of Patent: Oct. 20, 2009

(54) COMPONENT-LESS TERMINATION FOR ELECTROMAGNETIC COUPLERS USED IN HIGH SPEED/FREQUENCY DIFFERENTIAL SIGNALING

(75) Inventors: Tao Liang, Westford, MA (US); Bo Zhang, Boxborough, MA (US); John Critchlow, Northborough, MA (US); Timothy Wig, Northborough, MA (US); Larry Tate, Hopkinton, MA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/861,418

(22) Filed: Sep. 26, 2007

(65) Prior Publication Data

US 2009/0079522 A1 Mar. 26, 2009

(51) Int. Cl.
*H01P 5/02* (2006.01)
*H01P 5/18* (2006.01)

(52) U.S. Cl. ..... 333/24 R; 333/109

(58) Field of Classification Search ..... 333/24 R, 333/109

See application file for complete search history.

(56) References Cited

U.S. PATENT DOCUMENTS

| | | | | |
|---|---|---|---|---|
| 6,009,488 | A | 12/1999 | Kavipurapu | |
| 6,611,181 | B2 * | 8/2003 | Marketkar et al. | 333/24 R |
| 6,625,682 | B1 * | 9/2003 | Simon et al. | 710/305 |
| 7,002,430 | B2 | 2/2006 | Benham | |
| 7,202,756 | B2 | 4/2007 | Benham | |

* cited by examiner

*Primary Examiner*—Benny Lee
(74) *Attorney, Agent, or Firm*—David L. Guglielmi

(57) ABSTRACT

Component-less termination for electromagnetic couplers used in high speed/frequency differential signaling is described. In one embodiment, the apparatus includes a first signal line and a second signal line forming a differential pair, a first electromagnetic coupler to provide sampled electromagnetic signals from the first signal line, and a second electromagnetic coupler to provide sampled electromagnetic signals from the second signal line, wherein the first electromagnetic coupler is far end short circuited and wherein the second electromagnetic coupler is far end open circuited. Other embodiments are also described and claimed.

15 Claims, 2 Drawing Sheets

COMPONENT-LESS TERMINATION FOR ELECTROMAGNETIC COUPLERS USED IN HIGH SPEED/FREQUENCY DIFFERENTIAL SIGNALING

FIELD OF THE INVENTION

One or more embodiments of the invention relate generally to the field of electromagnetic coupling devices. More particularly, one or more of the embodiments of the invention relates to component-less termination for electromagnetic couplers used in high speed/frequency differential signaling.

BACKGROUND OF THE INVENTION

Communication between devices within a computer system may involve high speed/frequency data links. A resistive probe to validate the data link is less feasible not only because it may adversely affect the link under test, but also because a discrete resistor may be difficult to site.

BRIEF DESCRIPTION OF THE DRAWINGS

The various embodiments of the present invention are illustrated by way of example, and not by way of limitation, in the figures of the accompanying drawings and in which.

DETAILED DESCRIPTION OF THE INVENTION

Figure 1:
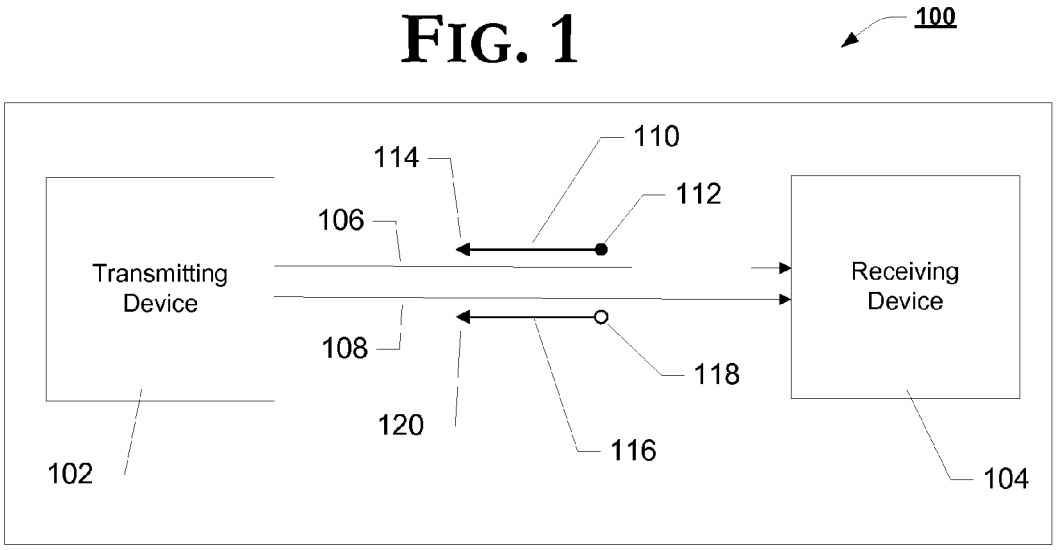
FIG. 1 is a block diagram of an example component-less termination for electromagnetic couplers, in accordance with one example embodiment of the invention.

A component-less termination for electromagnetic couplers used in high speed/frequency differential signaling is described. In one embodiment, the electromagnetic couplers sampling signals from a differential pair includes a first electromagnetic coupler that is far end open circuited, and a second electromagnetic coupler that is far end short circuited. While there may be noise reflected back from the far ends of the couplers to the near end probe, this noise from the first electromagnetic coupler and that from the second electromagnetic coupler induced from differential main signals have been found to be in same polarity to each other (thus in common mode) and not detrimental to the validation of the differential link data.

In the following description, numerous specific details such as logic implementations, sizes and names of signals and buses, types and interrelationships of system components, and logic partitioning/integration choices are set forth in order to provide a more thorough understanding. It will be appreciated, however, by one skilled in the art that the invention may be practiced without such specific details. In other instances, control structures and gate level circuits have not been shown in detail in order not to obscure the invention. Those of ordinary skill in the art, with the included descriptions, will be able to implement appropriate logic circuits without undue experimentation.

Electromagnetic coupling devices enable energy to be transferred between components of a system via interacting electric and magnetic fields. These interactions are quantified using coupling coefficients. The capacitive coupling coefficient ($K_C$) is the ratio of the per unit length coupling capacitance ($C_M$) to the geometric mean of the per unit length capacitance of the two coupled lines ($C_L$). Similarly, the inductive coupling coefficient ($K_L$) is the ratio of the per unit length mutual inductance ($L_M$) to the geometric mean of the per unit length inductance of the two coupled lines ($L_L$).

As known to those skilled in the art, any parallel coupled pair of transmission lines yields electromagnetic coupling, sometimes referred to by those skilled in the art as crosstalk. In other words, crosstalk is the transfer of information from one signal that may or may not interfere with another signal. In electromagnetic coupler based probing solution, the coupled signal at coupler near end carries sufficient information for logical validation.

In addition, although an embodiment described herein is directed to an electromagnetic coupler, it will be appreciated by those skilled in the art that the embodiments of the present invention can be applied to other systems. Other structures may fall within the embodiments of the present invention, as defined by the appended claims. The embodiments described above were chosen and described in order to best explain the principles of the embodiments of the invention and its practical applications. These embodiments were chosen to thereby enable others skilled in the art to best utilize the invention and various embodiments with various modifications as are suited to the particular use contemplated.

FIG. 1 is a block diagram of an example component-less termination for electromagnetic couplers, in accordance with one example embodiment of the invention. As shown, system 100 includes transmitting device 102, receiving device 104, main p signal 106, main n signal 108, p signal coupler 110, p signal coupler far end 112, p signal coupler near end 114, n signal coupler 116, n signal coupler far end 118, and n signal coupler near end 120.

Transmitting device 102 and receiving device 104 may represent any type of integrated circuit device. In one embodiment, transmitting device 102 may be a processor or controller and receiving device may be a memory or I/O device, for example. Transmitting device 102 and receiving device 104 may be integrated into the same platform, such as a printed circuit board, or may be incorporated into separate platforms separated by some distance.

Main p signal 106 and main n signal 108 (which one skilled in the art would recognize may represent complementary positive and negative signals) form a differential pair for transmitting device 102 to send data to receiving device 104. As known in the art, differential signaling offers advantages over single-ended signaling in high speed/frequency signaling, particularly in terms of noise immunity. In one embodiment, main p signal 106 and main n signal 108 comprise matching lengths and geometries, and need not be straight as shown.

P signal coupler 110 and n signal coupler 116 represent electromagnetic couplers to provide sampled electromagnetic signals from main p signal 106 and main n signal 108, respectively. In one embodiment, p signal coupler 110 and n signal coupler 116 have matching lengths and conform to the geometry of main p signal 106 and main n signal 108, respectively.

In one example embodiment, p signal coupler 110 is short circuited (tied to ground) at p signal coupler far end 112 and n signal coupler 116 is open circuited (unterminated) at n signal far end 118. While this will result in energy being reflected back to p signal coupler near end 114 and n signal coupler near end 120, the reflected energy is effectively converted to a common-mode signal due to the reflection coefficients that are 180 degrees out of phase. This enables effective separation of the desired near end coupled energy from the far end reflected energy based on mode orthogonality. With proper common mode termination (not shown in FIG. 1 for simplicity) built into the interconnect channel, the reflected far end forward coupled energy (in common mode) will not interfere with the desired near end signal (in differential mode).

Figure 2:
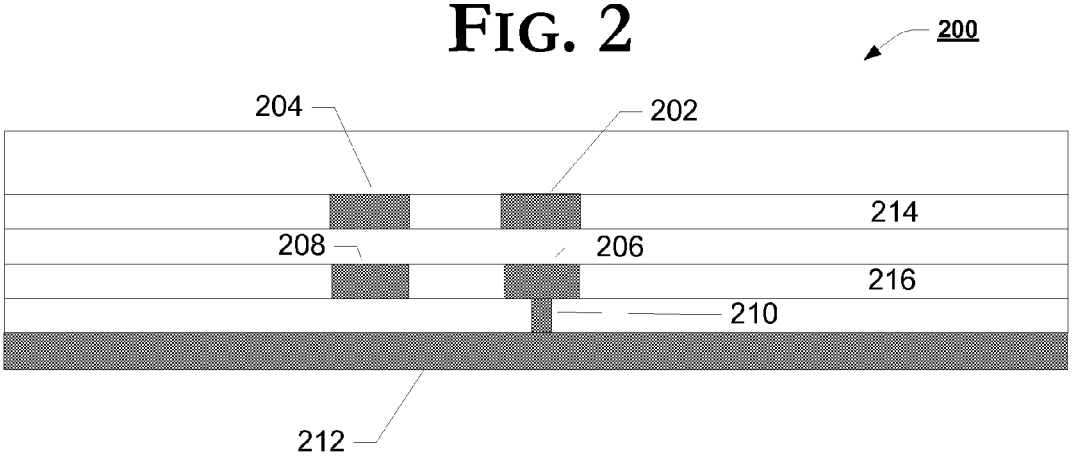
FIG. 2 is a graphical illustration of a cross-sectional view of an example component-less termination for electromagnetic couplers, in accordance with one example embodiment of the invention.

FIG. 2 is a graphical illustration of a cross-sectional view of an example component-less termination for electromagnetic couplers, in accordance with one example embodiment of the invention. As shown, system 200 includes main p signal 202, main n signal 204, p signal coupler 206, n signal coupler 208, via 210, ground plane 212, metal layer 214, and metal layer 216.

In one embodiment, p signal coupler 206, which provides sampled electromagnetic signals from main p signal 202, is connected to ground plane 212 by via 210 at coupler far end. Conversely, n signal coupler 208, which provides sampled electromagnetic signals from main n signal 204, is far end unterminated.

In one embodiment, main signals 202 and 204 reside on metal layer 214 while electromagnetic couplers 206 and 208 reside on metal layer 216. In another embodiment, main signals 202 and 204 reside on the same metal layer as electromagnetic couplers 206 and 208.

Figure 3:
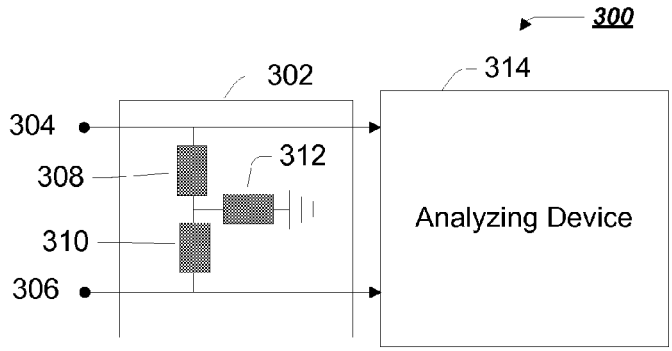
FIG. 3 is a block diagram of an example termination network at probing receiver for use with component-less termination for electromagnetic couplers, in accordance with one example embodiment of the invention.

FIG. 3 is a block diagram of an example termination network at probing receiver for use with component-less termination for electromagnetic couplers, in accordance with one example embodiment of the invention. As shown, system 300 includes termination network 302, coupled n signal 304, coupled p signal 306, termination resistors 308, 310 and 312, and analyzing device 314.

The termination network 302 is designed to receive the coupled n signal 304 and coupled p signal 306 from electromagnetic couplers (for example couplers 110 and 116 from FIG. 1) and forward them to analyzing device 314. In one embodiment, termination network 302 includes termination resistors 308, 310 and 312 in a receiver matching network to match common mode impedance and differential impedance simultaneously. The common mode signals from far end coupling are absorbed by the termination matching network, and do not interfere with desirable differential signals from near end coupling because of the mode orthogonolity. In this example, if termination resistors 308 and 310 have a value of R1 and termination resistor 312 has a value of R2, the differential impedance would be 2*R1 and the common mode impedance would be 0.5*R1+R2.

Analyzing device 314 may represent any oscilloscope capable of analyzing differential mode signals.

Figure 4:
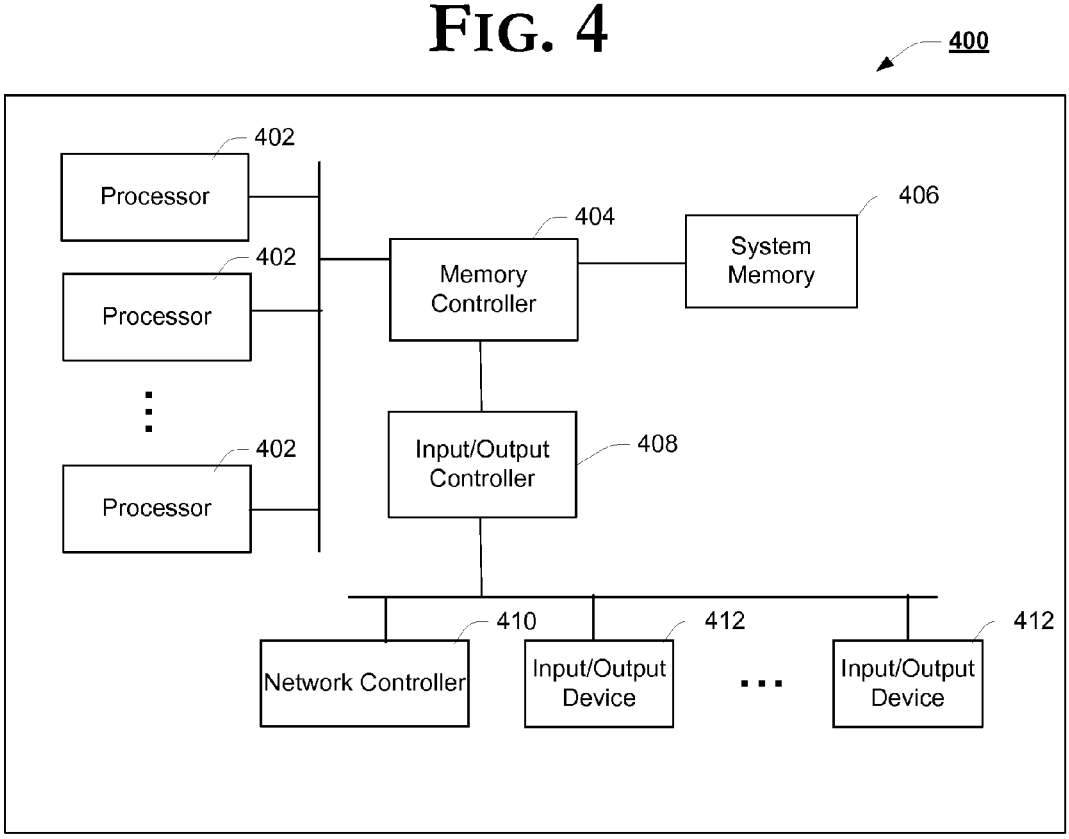
FIG. 4 is a block diagram of an example electronic appliance suitable for component-less termination for electromagnetic couplers, in accordance with one example embodiment of the invention.

FIG. 4 is a block diagram of an example electronic appliance suitable for component-less termination for electromagnetic couplers, in accordance with one example embodiment of the invention. Electronic appliance 400 is intended to represent any of a wide variety of traditional and non-traditional electronic appliances, laptops, cell phones, wireless communication subscriber units, personal digital assistants, or any electric appliance that would benefit from the teachings of the present invention. In accordance with the illustrated example embodiment, electronic appliance 400 may include one or more of processor(s) 402, memory controller 404, system memory 406, input/output controller 408, network controller 410, and input/output device(s) 412 coupled as shown in FIG. 4. Electronic appliance 400 may include connections between components that are differential pairs including electromagnetic couplers with component-less termination described previously as an embodiment of the present invention.

Processor(s) 402 may represent any of a wide variety of control logic including, but not limited to one or more of a microprocessor, a programmable logic device (PLD), programmable logic array (PLA), application specific integrated circuit (ASIC), a microcontroller, and the like, although the present invention is not limited in this respect. In one embodiment, processors(s) 402 are compatible processors available from Intel® Corporation. Processor(s) 402 may have an instruction set containing a plurality of machine level instructions that may be invoked, for example by an application or operating system.

Memory controller 404 may represent any type of chipset or control logic that interfaces system memory 406 with the other components of electronic appliance 400. In one embodiment, the connection between processor(s) 402 and memory controller 404 may be a high speed/frequency serial link including one or more differential pairs. In another embodiment, memory controller 404 may be incorporated into processor(s) 402 and differential pairs may directly connect processor(s) 402 with system memory 406.

System memory 406 may represent any type of memory device(s) used to store data and instructions that may have been or will be used by processor(s) 402. Typically, though the invention is not limited in this respect, system memory 406 will consist of dynamic random access memory (DRAM). In one embodiment, system memory 406 may consist of Rambus DRAM (RDRAM). In another embodiment, system memory 406 may consist of double data rate synchronous DRAM (DDRSDRAM).

Input/output (I/O) controller 408 may represent any type of chipset or control logic that interfaces I/O device(s) 412 with the other components of electronic appliance 400. In one embodiment, I/O controller 408 may be referred to as a south bridge. In another embodiment, I/O controller 408 may comply with the Peripheral Component Interconnect (PCI) Express™ Base communication protocol Specification, Revision 1.0a, PCI Special Interest Group, released Apr. 15, 2003.

Network controller 410 may represent any type of device that allows electronic appliance 400 to communicate with other electronic appliances or devices. In one embodiment, network controller 410 may comply with a The Institute of Electrical and Electronics Engineers, Inc. (IEEE) 802.11b standard (approved Sep. 16, 1999, supplement to ANSI/IEEE Std 802.11, 1999 Edition). In another embodiment, network controller 410 may be an Ethernet network interface card.

Input/output (I/O) device(s) 412 may represent any type of device, peripheral or component that provides input to or processes output from electronic appliance 400.

It is to be understood that even though numerous characteristics and advantages of various embodiments of the present invention have been set forth in the foregoing description, together with details of the structure and function of various embodiments of the invention, this disclosure is illustrative only. In some cases, certain subassemblies are only described in detail with one such embodiment. Nevertheless, it is recognized and intended that such subassemblies may be used in other embodiments of the invention. Changes may be made in detail, especially matters of structure and management of parts within the principles of the embodiments of the invention to the full extent indicated by the broad general meaning of the terms in which the appended claims are expressed.

Having disclosed exemplary embodiments and the best mode, modifications and variations may be made to the disclosed embodiments while remaining within the scope of the embodiments of the invention as defined by the following claims.

What is claimed is:

1. An apparatus comprising:

a first signal line and a second signal line forming a differential pair;

a first electromagnetic coupler to provide sampled electromagnetic signals from the first signal line; and a second electromagnetic coupler to provide sampled electromagnetic signals from the second signal line, wherein the first electromagnetic coupler is far end short circuited and wherein the second electromagnetic coupler is far end open circuited, wherein the far ends of the first and second electromagnetic couplers are ends nearest a receiving device.

2. The apparatus of claim 1, wherein the first signal line and the second signal line comprise substantially matching lengths and geometries.

3. The apparatus of claim 1, wherein the first and second signal lines comprise different metal layers than the electromagnetic couplers.

4. The apparatus of claim 1, further comprising a probing receiver to receive near end signals from the first and second electromagnetic couplers, wherein the near ends of the first and second electromagnetic couplers are ends nearest a transmitting device.

5. The apparatus of claim 4, further comprising a termination network at the probing receiver comprising a matched common mode impedance and a matched differential impedance.

6. A system comprising:

a network controller;

a memory;

a processor;

a differential pair coupled with the processor and the memory, the differential pair containing a first signal line and a second signal line;

a first electromagnetic coupler to provide sampled electromagnetic signals from the first signal line; and a second electromagnetic coupler to provide sampled electromagnetic signals from the second signal line, wherein the first electromagnetic coupler is far end open circuited and wherein the second electromagnetic coupler is far end short circuited, wherein the far ends of the first and second electromagnetic couplers are ends nearest a receiving device.

7. The system of claim 6, wherein the first electromagnetic coupler and the second electromagnetic coupler comprise substantially matching lengths and geometries.

8. The system of claim 6, further comprising a probing receiver to receive near end signals from the first and second electromagnetic couplers, wherein the near ends of the first and second electromagnetic couplers are ends nearest a transmitting device.

9. The system of claim 6, wherein the first and second signal lines comprise different metal layers than the electromagnetic couplers.

10. The system of claim 6, further comprising a termination network for impedance matching for coupled signals received from the electromagnetic couplers.

11. An apparatus comprising:

an integrated circuit device;

a differential signaling pair coupled with the integrated circuit device, the differential pair containing a first signal line and a second signal line;

a first electromagnetic coupler to provide sampled electromagnetic signals from the first signal line; and a second electromagnetic coupler to provide sampled electromagnetic signals from the second signal line, wherein the first electromagnetic coupler is far end open circuited and wherein the second electromagnetic coupler is far end short circuited, wherein the far ends of the first and second electromagnetic couplers are ends nearest a receiving device.

12. The apparatus of claim 11, further comprising a probing receiver to receive near end signals from the first and second electromagnetic couplers, wherein the near ends of the first and second electromagnetic couplers are ends nearest a transmitting device.

13. The apparatus of claim 11, wherein the first and second signal lines comprise different metal layers than the electromagnetic couplers.

14. The apparatus of claim 11, further comprising a termination network for impedance matching for coupled signals received from the electromagnetic couplers.

15. The apparatus of claim 11, wherein the first electromagnetic coupler and the second electromagnetic coupler comprise substantially matching lengths and geometries.

* * * * *